US005360385A

United States Patent [19]

Wang

[11] Patent Number: 5,360,385

[45] Date of Patent: Nov. 1, 1994

[54] HAND DEVELOPER

[76] Inventor: Ro-Pin Wang, 5F, No. 1, Lane 85 Kwang Fu North Rd., Taipei City, Taiwan, Prov. of China

[21] Appl. No.: 99,552

[22] Filed: Jul. 30, 1993

[51] Int. Cl.[5] ..... A63B 23/16

[52] U.S. Cl. ..... 482/49; 482/126; 482/128

[58] Field of Search ..... 482/49, 126, 128, 44

[56] References Cited

U.S. PATENT DOCUMENTS 4,753,434 6/1988 Salvino ..... 482/49

5,072,927 12/1991 Santos ..... 482/49

*Primary Examiner*—Richard J. Apley

*Assistant Examiner*—Lynne A. Reichard

*Attorney, Agent, or Firm*—Browdy and Neimark

[57] ABSTRACT

A hand developing device comprises two handles, one elastic element and one adjusting member. The two handles are so pivoted together at one end thereof as to form a pivoting point serving as a fulcrum on which the two handles turn. The elastic element is disposed between the two handles such that the elastic element can be forced out of shape by the pressing portions of the two handles so as to bring about a damping effect. The elastic element is capable of returning mildly to its original form after being forced out of shape by the two handles. The adjusting member is disposed between the two handles such that the adjusting member facilitates an adjustment of the distance between the center of the elastic element and the pivoting point of the two handles, thereby resulting in a change in the damping magnitude of the hand developing device.

4 Claims, 1 Drawing Sheet

HAND DEVELOPER

FIELD OF THE INVENTION

The present invention relates generally to a body building device, and more particularly to a hand developing device provided with an adjustable damping means such that the hand developing device can be used comfortably.

BACKGROUND OF THE INVENTION

The prior art hand developer is generally composed of a torsion spring, which is disposed between the two handles of the hand developer and intended to serve as a damping mechanism of the hand developer. Such a prior art hand developing device as described above has inherent shortcomings, which are described explicitly hereinafter.

When two handles of the prior art hand developer are pressed by hand to move in opposite directions, the torsion spring disposed between the two handles is so compressed as to generate a quantity of energy, which is stored in the compressed torsion spring. Upon the release of the handles, the stored energy causes abruptly the compressed torsion spring to restore its original form. Such a restoring process takes place abruptly and forcefully such that the hands holding the two handle are often hit by the handles.

The damping effect provided by the torsion spring of the prior art hand developer is so constant that it is not adjustable. As a result, the prior art hand developer is not suitable for use by all persons regardless of their body sizes.

The damping value of the prior art hand developer can not be increased in a direct proportion to the sum of the training hours that a user of the hand developer has accumulated. As a result, the user has to use another hand developer which affords a relatively greater damping effect.

The torsion spring of the prior art hand developer is vulnerable to the spring fatigue, thereby undermining the service life span of the prior art hand developer.

SUMMARY OF THE INVENTION

It is therefore the primary objective of the present invention to provide a hand developer with an adjustable means of damping effect.

It is another objective of the present invention to provide a hand developer, which can be used comfortably.

It is still another objective of the present invention to provide a hand developer suitable for use by all persons regardless of their hand sizes.

It is still another objective of the present invention to provide a hand developer of a considerable longevity.

The foregoing objectives of the present invention are accomplished by an improved hand developer, which comprises two handles and one elastic element. The two handles are pivoted together such that they can be caused by one hand to move in opposite directions on the pivoting point serving as a fulcrum. The elastic element is disposed between the two handles so as to provide the hand developer with a damping effect. The improved hand developer of the present invention is characterized in that the two handles are provided respectively in an inner side thereof with a pressing portion. The elastic element of a soft elastic material is pressed by the pressing portions of the two handles so as to provide the hand developer of the present invention with a damping effect.

Upon the release of the two handles that are forced by hand to stay close together, the compressed elastic element of the hand developer of the present invention is permitted to restore its original form in a relatively gradual manner that a person's hand holding the handles is not subjected to a bodily pain or injury.

The improved hand developer of the present invention is further characterized in that it comprises an adjusting member disposed between the handles and the elastic element such that the distance between the elastic element and the pivoting point of the two handles can be adjusted by the adjusting member so as to alter the length of the lever of resistance. Accordingly, the damping value of the hand developer of the present invention can be adjusted as desired.

DETAILED DESCRIPTION OF THE INVENTION

Figure 1:
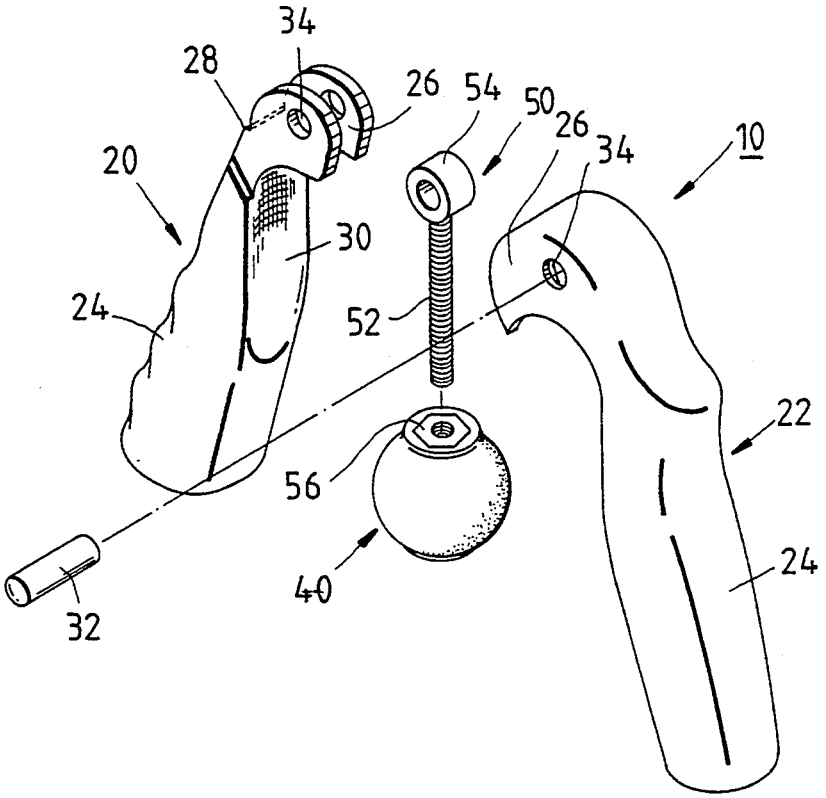
FIG. 1 shows an exploded view of an embodiment of the present invention.
Figure 2:
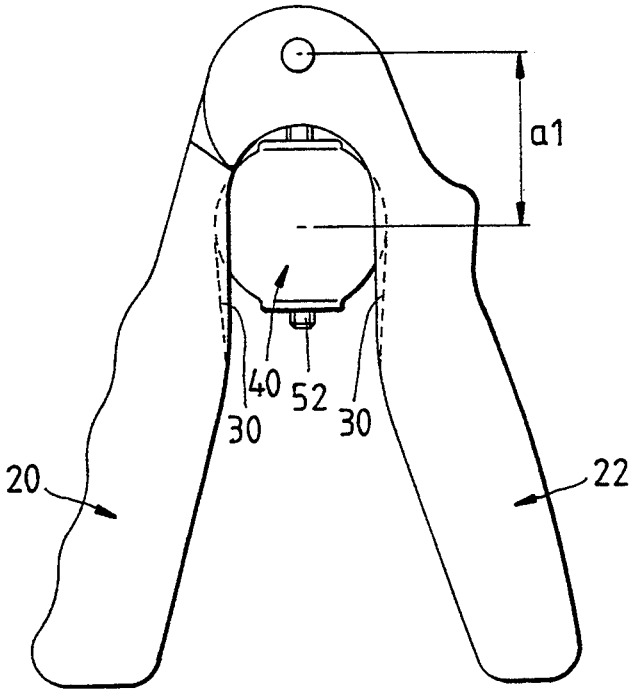
FIG. 2 shows a front elevational view of the embodiment in combination, according to the present invention as shown in FIG. 1.

Referring to FIGS. 1 and 2, an improved hand developer 10 of the present invention is shown to comprise two handles 20 and 22, one elastic element 40 and one adjusting member 50.

Each of the two handles 20 and 22 has a grip portion 24 and two lugs 26 located at a pivoting end of the handle. The lug 26 of the handle 20 is provided on the hind side thereof with a stepped portion 28. Each of the two handles 20 and 22 is provided on the inner side thereof with a pressing portion 30 of arcuate construction. In addition, a pin 32 is received in two through holes 34 of the two lugs 26 of the two handles 20 and 22. As a result, the two handles 20 and 22 can be caused to turn on the pin 32 such that the edge of the lug 26 of the handle 22 is stopped by the stepped portion 28 of the handle 20 so as to ensure that the rotations of the handles 20 and 22 take place within a range of a predetermined angle.

The elastic element 40 is made of a soft elastic material, such as a rubber material. The elastic element 40 of spherical construction is disposed between the two handles 20, 22 and is corresponding in location to the two pressing portions 30 of the two handles 20 and 22.

The adjusting member 50 is disposed between the elastic element 40 and the two handles 20 and 22. The adjusting member 50 may be of a construction as shown in FIG. 1 or of an equivalent construction. The adjusting member 50 comprises a rod serving as a pivoting member 52 having a threaded outer surface and a pivoting portion 54 located at one end thereof and mounted pivotally on the pin 32. The adjusting member 50 further comprises an adjusting piece 56 of a nut construction, which is fitted securely into an axial hole (not shown in the drawings) of the elastic element 40 such that the adjusting piece 56 is engageable with the pivoting member 52 of the adjusting member 50.

The hand developer 10 in combination of the present invention is shown in FIG. 2. An exerciser uses his or her hand to hold the handles 20 and 22 of the hand developer 10. When the two handles 20 and 22 are pressed by hand to move in opposite directions, the elastic element 40 is so pressed by the pressing portions 30 of the two handles 20 and 22 as to become deformed. As a result, a quantity of energy is generated and stored in the compressed elastic element 40. As soon as the pressed handles 20 and 22 are released, the energy stored in the elastic element 40 causes the compressed elastic element 40 to restore its original form, thereby causing the pressed handles 20 and 22 to move back to their original positions. The effect of the hand-developing exercise is therefore realized by repeating the process described above.

Figure 3:
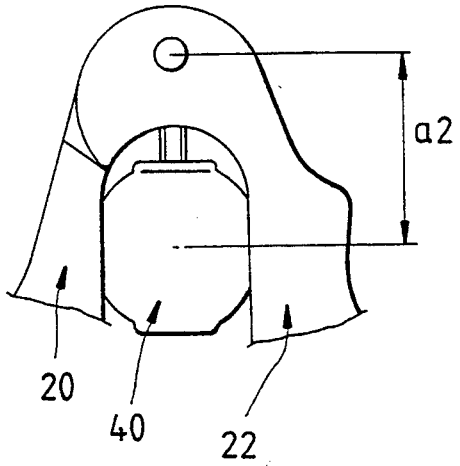
FIG. 3 is a schematic view illustrating the working of the adjustment of the elastic element of the embodiment of the present invention.

As illustrated in FIG. 2, the elastic element 40 has a center which remains apart from the pivoting point by a distance designated as a1. This means that the magnitude of the damping effect of the hand developer 10 of the present invention is dependent on the distance a1. Now referring to FIG. 3, the elastic element 40 has been so rotated downwards as to alter the position at which the adjusting piece 56 is pivoted to the pivoting member 52. As a result, the center of the elastic element 40 has been relocated downwards to remain farther apart from the pivoting point of the two handles 20 and 22 by a distance designated as a2 which is greater than the distance a1. This means that the hand developer 10, as shown in FIG. 3, has a greater damping effect than the same hand developer 10 which is shown in FIG. 2. This is due to the fact that the hand developer 10 of FIG. 3 has a greater length of lever of resistance (a2) and that the magnitude of the damping effect of the hand developer 10 of the present invention is directly proportional to the length of lever of resistance.

The advantages inherent in the present invention are therefore readily apparent and further expounded hereinafter.

The damping effect of the hand developer of the present invention can be adjusted as desired by the user, thereby making the hand developer of the present invention suitable for use by persons of all body sizes.

The user's hand holding the hand developer of the present invention is not subjected to a bodily pain or even injury caused by the pressed handles of the hand developer at the time when the pressed handles are released.

The magnitude of the damping value of the hand developer of the present invention can be adjusted higher in a progressive manner for the training purpose.

The service life span of the hand developer of the present invention is longer as compared with the prior art hand developer. In case the damping effect of the elastic element of the present invention is undermined by the mechanical fatigue of the elastic element, the damping value of the hand developer can be so adjusted as to compensate for the fatigue of the elastic element. The prior art hand developer is not provided with such a luxury permitting a compensation for the loss of the damping effect caused by the fatigue of the damping element of the prior art hand developer.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. A hand developer comprising:

two handles pivoted together at one end thereof such that said two handles can be moved in the same direction or the opposite directions within a predetermined range of angle; and one elastic element disposed between said two handles for providing an elastic damping effect;

wherein said two handles have a pivoting point to which one end of a pivoting member of a long rod-shaped construction is pivoted such that the body of said pivoting member is located between said two handles; and wherein said elastic element has an adjusting member fastened thereto for enabling said elastic element to be fastened to said pivoting member in such a manner that the position of said elastic element can be adjusted along the longitudinal axis of said pivoting member, so as to change the distance between said elastic element and the pivoting point of said two handles.

2. The hand developer of claim 1 wherein said pivoting member is a threaded rod; and wherein said adjusting member is a nut for use in fastening said elastic element to said threaded rod such that said distance between said elastic element and said pivoting point of said two handles can be adjusted by threads of said threaded rod.

3. The hand developer of claim 2 wherein said elastic element is provided with an axial hole; and wherein said adjusting member comprises a pivoting piece and an adjusting piece, with said pivoting piece having one end mounted on said pivoting point of said two handles, and with said adjusting piece being fitted securely into said axial hole of said elastic element such that said adjusting piece engages adjustably a free end of said pivoting piece.

4. The hand developer of claim 1 wherein said elastic element has a spherical in shape; and wherein said pressing portion of each of said two handles is arcuate in shape and in conformity with said spherical shape of said elastic element.

* * * * *